US007909096B2

(12) United States Patent
Clark et al.

(10) Patent No.: US 7,909,096 B2
(45) Date of Patent: Mar. 22, 2011

(54) METHOD AND APPARATUS OF RESERVOIR STIMULATION WHILE RUNNING CASING

(75) Inventors: Brian Clark, Sugar Land, TX (US); J. Ernest Brown, Cambridge (GB); Marc Jean Thiercelin, Ville D'Avray (FR); Arkady Segal, Moscow (RU); Ian D. Bryant, Houston, TX (US); Matthew J. Miller, Cambridge (GB); Valerie Jochen, College Station, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 385 days.

(21) Appl. No.: 12/035,953

(22) Filed: Feb. 22, 2008

(65) Prior Publication Data

US 2008/0210422 A1 Sep. 4, 2008

Related U.S. Application Data

(60) Provisional application No. 60/892,633, filed on Mar. 2, 2007.

(51) Int. Cl.
*E21B 43/25* (2006.01)

(52) U.S. Cl. ..... 166/250.17; 166/305.1; 166/387

(58) Field of Classification Search ..... 166/250.01, 166/250.17, 305.1, 382, 387, 127, 191, 177.5, 166/254.2

See application file for complete search history.

(56) References Cited

U.S. PATENT DOCUMENTS

| | | | | |
|---|---|---|---|---|
| 3,669,190 | A | 6/1972 | Sizer et al. | |
| 4,567,944 | A * | 2/1986 | Zunkel et al. | 166/120 |
| 4,569,396 | A * | 2/1986 | Brisco | 166/305.1 |
| 5,117,915 | A | 6/1992 | Mueller et al. | |
| 5,181,571 | A | 1/1993 | Mueller et al. | |
| 6,186,227 | B1 | 2/2001 | Vaynshteyn et al. | |
| 6,315,050 | B2 | 11/2001 | Vaynshteyn et al. | |
| 6,564,876 | B2 | 5/2003 | Vaynshteyn et al. | |
| 6,883,608 | B2 | 4/2005 | Parlar et al. | |
| 6,915,848 | B2 | 7/2005 | Thomeer et al. | |
| 7,040,402 | B2 * | 5/2006 | Vercaemer | 166/253.1 |
| 7,066,265 | B2 | 6/2006 | Surjaatmadja | |
| 7,147,068 | B2 * | 12/2006 | Vail, III | 175/65 |

(Continued)

FOREIGN PATENT DOCUMENTS

| | | | |
|---|---|---|---|
| GB | 2385364 | A | 8/2003 |
| GB | 2398585 | A | 8/2004 |
| GB | 2409692 | A | 7/2005 |
| GB | 2409693 | A | 7/2005 |
| GB | 2409694 | A | 7/2005 |

(Continued)

*Primary Examiner* — David J Bagnell
*Assistant Examiner* — Cathleen R Hutchins
(74) *Attorney, Agent, or Firm* — Michael Dae; David Cate; Robin Nava

(57) ABSTRACT

A method for stimulating a reservoir formation while running a casing string into the wellbore includes the steps of: connecting a stimulation assembly to a casing string, the stimulation assembly including a packer actuator in operational connection with a packer and a logging sensor; running the casing string into the wellbore and positioning the logging assembly proximate to a selected reservoir formation; logging the reservoir formation; positioning the stimulation assembly proximate to the reservoir formation; actuating the packer to substantially isolate the reservoir formation from the wellbore; performing the stimulation operation; releasing the packers from sealing engagement with the wellbore; positioning the logging assembly proximate to the reservoir formation; logging the reservoir formation; and disconnecting the stimulation assembly from the casing string.

12 Claims, 7 Drawing Sheets

U.S. PATENT DOCUMENTS

| | | | | |
|---|---|---|---|---|
| 7,222,676 | B2 | 5/2007 | Patel et al. | |
| 2001/0050170 | A1* | 12/2001 | Woie et al. | 166/252.1 |
| 2001/0050172 | A1* | 12/2001 | Tolman et al. | 166/297 |
| 2002/0007949 | A1* | 1/2002 | Tolman et al. | 166/280 |
| 2002/0166698 | A1 | 11/2002 | Beato et al. | |
| 2006/0180319 | A1 | 8/2006 | Lucas et al. | |
| 2007/0227725 | A1 | 10/2007 | Xu et al. | |

FOREIGN PATENT DOCUMENTS

| | | | |
|---|---|---|---|
| GB | 2426019 | A | 11/2006 |
| WO | 2004040094 | A1 | 5/2004 |
| WO | 2004072434 | A2 | 8/2004 |
| WO | 2004079151 | A2 | 9/2004 |
| WO | 2007076609 | A1 | 7/2007 |

* cited by examiner

METHOD AND APPARATUS OF RESERVOIR STIMULATION WHILE RUNNING CASING

RELATED APPLICATIONS

This application claims the benefit of U.S. Provisional Patent Application Ser. No. 60/892,633 filed Mar. 2, 2007.

FIELD

The present invention relates in general to wellbore operations and more specifically to methods and systems for stimulating reservoir formations while running casing into the wellbore.

BACKGROUND

The statements in this section merely provide background information related to the present disclosure and may not constitute prior art.

Typically, after a well is completed with casing, selected reservoir formations or zones are fractured to stimulate the reservoir formation. The typical process includes locating the desired formation through the casing, perforating the casing, performing the fracturing operation which commonly includes additional reservoir stimulation operations, and then pulling out of the well with the stimulation assembly.

Performing fracture stimulation operations after the casing as been cemented in place can result in less than satisfactory fracturing and/or stimulation. Performing operations after completing the well with casing also means making additional trips into and out of the well, thereby increasing the cost of operations. Further, in wells with multiple zones for treatment this prior method can be cost prohibitive for targeted stimulation of each of the desired zones.

SUMMARY

An example of a bottom-hole assembly for conducting wellbore operations while running casing into a wellbore includes a latch assembly adapted to connect to the casing string, a pair of spaced apart packers, and a packer actuator operationally connected to the packers and the latch assembly.

An example of a method for conducting wellbore operations in a well while running casing into the wellbore, comprises the steps of: connecting a stimulation assembly to a casing string; running the casing string into the wellbore; positioning the stimulation assembly at a selected reservoir formation; performing a stimulation operation at the reservoir formation; and running the casing string and stimulation assembly to the next desired position in the wellbore.

An example of a method for stimulating a reservoir formation while running a casing string into the wellbore includes the steps of: connecting a stimulation assembly to a casing string, the stimulation assembly including a packer actuator in operational connection with a packer and a logging sensor; running the casing string into the wellbore and positioning the logging assembly proximate to a selected reservoir formation; logging the reservoir formation; positioning the stimulation assembly proximate to the reservoir formation; actuating the packer to substantially isolate the reservoir formation from the wellbore; performing the stimulation operation; releasing the packers from sealing engagement with the wellbore; positioning the logging assembly proximate to the reservoir formation; logging the reservoir formation; and disconnecting the stimulation assembly from the casing string.

The foregoing has outlined some of the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
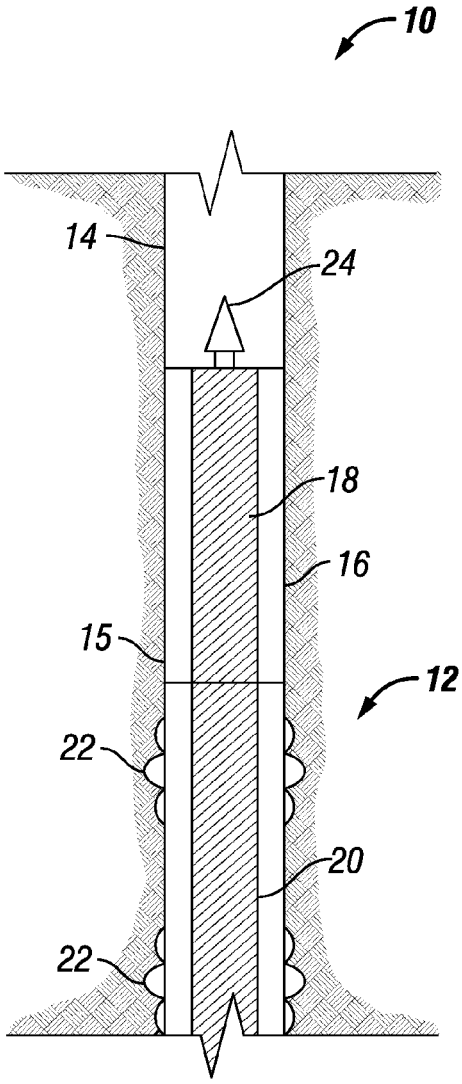
FIG. 1 is a partial cross-sectional view of an example of an assembly for stimulating reservoir formations while running casing.

Refer now to the drawings wherein depicted elements are not necessarily shown to scale and wherein like or similar elements are designated by the same reference numeral through the several views. At the outset, it should be noted that in the development of any such actual embodiment, numerous implementation—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure.

As used herein, the terms "up" and "down"; "upper" and "lower"; and other like terms indicating relative positions to a given point or element are utilized to more clearly describe some elements. Commonly, these terms relate to a reference point as the surface from which drilling operations are initiated as being the top point and the total depth of the well being the lowest point.

In accordance with the invention, some embodiments use a bottom-hole assembly for conducting wellbore operations while running casing into a wellbore, where the bottom-hole assembly includes a latch assembly adapted to connect to the casing string, a pair of spaced apart packers, and a packer actuator operationally connected to the packers and the latch assembly. While some embodiments use packers with a bottom hole assembly, this is only one type of approach to achieve controlled placement of fractures while running the casing. The bottomhole assembly may be used to help control the fracture initiation point while the casing is being run-in-hole, but this may be with packers or any other appropriate configuration(s). The assembly will help ensure that each fracture is placed (initiated) from the wellbore at a given desired location. In general, the first fracture would be placed in the shallowest portion (smallest measured depth) of the openhole section across the producing reservoir. Subsequent fractures will be placed at deeper depths (deeper meaning further into the well or larger measured depth).

The point of fracture initiation may be controlled, for example, by: 1) containing and increasing the hydrostatic pressure at a given point or; 2) reducing the fracture breakdown pressure of the reservoir rock. To control fracture placement either hydrostatic pressure may be increased at a specific location, or alternatively, the frac gradient reduced at the location, or suitable combination of both. One example of a technique to increase hydrostatic pressure is to apply openhole tandem packers or an openhole packer and a corresponding bridge plug. Once the packers or packer/bridge plug combination are set and pumping begins (allowing fluid to only enter between the isolating elements) the hydrostatic pressure will increase between the packers until the formation fracture gradient is exceeded. The fracture will be initiated at some indeterminate point between the packers at this pressure. Other portions of the open hole wellbore will not be subject to the increased hydrostatic pressure and will remain unfractured. To fracture at another point along the wellbore, the packers or packer/bridge plug combination will be moved to another section of the open hole wellbore and the fracturing process can be repeated. Packers as described are generally thought of to be expanding or swelling materials (i.e. elastomers, etc.) that can be expanded and contracted. Sometimes the packing element is expanded by placing an elastic material in compression while other packing elements are expanded by pumping fluids into an elastomer covered container that increases in size as fluid pressure is added. However, for this context a packer should be anything that helps to contain hydrostatic pressure. An approach for lowering the fracture breakdown pressure is to simply make the hole larger in the location to start the fracture. This can be done by using an under-reamer. The fracture location could also be perforated in the openhole section. Also, abrasively jetting slots into the openhole walls of the borehole can be done. These types of fracture placement can be effective, and an alternative to the use of packers.

Figure 2:
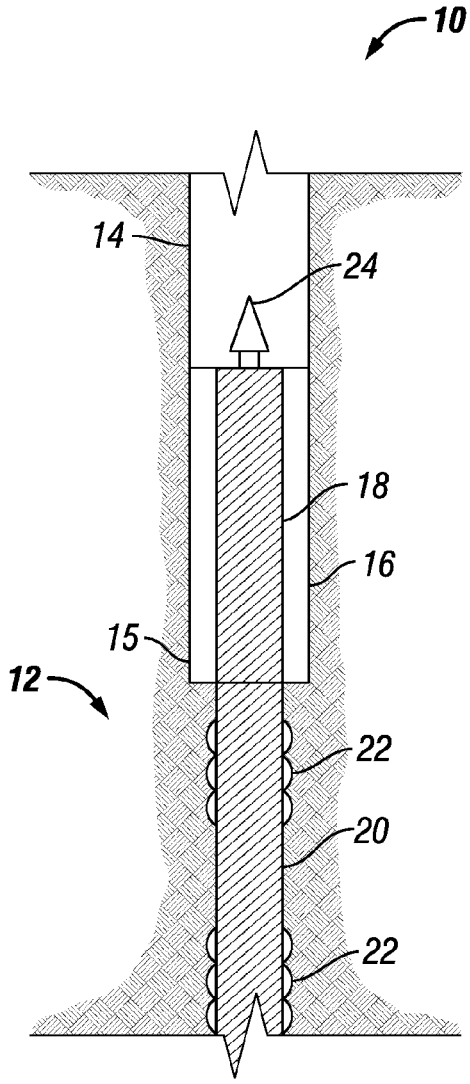
FIG. 2 is a partial cross-sectional view of another example of an assembly for stimulating reservoir formations while running casing.

FIGS. 1 and 2 are cross-sectional views of examples of a stimulation while running an embodiment of a casing system of the present invention, generally denoted by the numeral 10. For purposes of description the system and method will be described from time to time for fracturing, stimulating, and fracture stimulation. These terms may be utilized interchangeably to include one or more operations that may be performed in an effort to improve the productivity or injectivity of a formation. It is common to perform fracturing operations to create fissures in the formation, which may or may not be held open by proppants that are introduced during the operation. Additional formation stimulation methods that may be run singularly or in combination with fracturing operations include chemical stimulation, for example with an acid.

System 10 includes a bottom-hole assembly ("BHA") referred to herein as a stimulation assembly 12 that is in functional connection with a casing sting 14. Stimulation assembly 12 is positioned proximate to the bottom 15 of casing string 14. Stimulation assembly 12 includes latch assembly 18, packer actuator 20 or mandrel and seal elements 22, referred to herein as packers 22. Latch assembly 18 may be provided to removably connect assembly 12 to casing 14, for example via nipple profile 16, so that assembly 12 can be retrieved from the wellbore after operations. Assembly 12 may also include a retrieval member 24, such as a fishing head, for retrieving assembly 12 upon the completion of operations.

Packers 22 are sealing members generally referred to as packers and may include various elements such as without limitation, expandable or inflatable packers and straddle packers. Packers 22 are functionally connected to packer actuator 20 which may be a mandrel or other assembly adapted for actuating, for example inflating or expanding, the utilized packers 22.

In FIG. 1, packers 22 are disposed on an exterior, or outside diameter, of a portion 26 of casing 14. In this example, portion 26 is a casing sub connected to bottom 15 of casing string 14. In the example shown in FIG. 2, packers 22 are carried on packer mandrel 20. In this example, packers 22 are retrieved with assembly 12 after the completion of stimulation operations.

Figure 3:
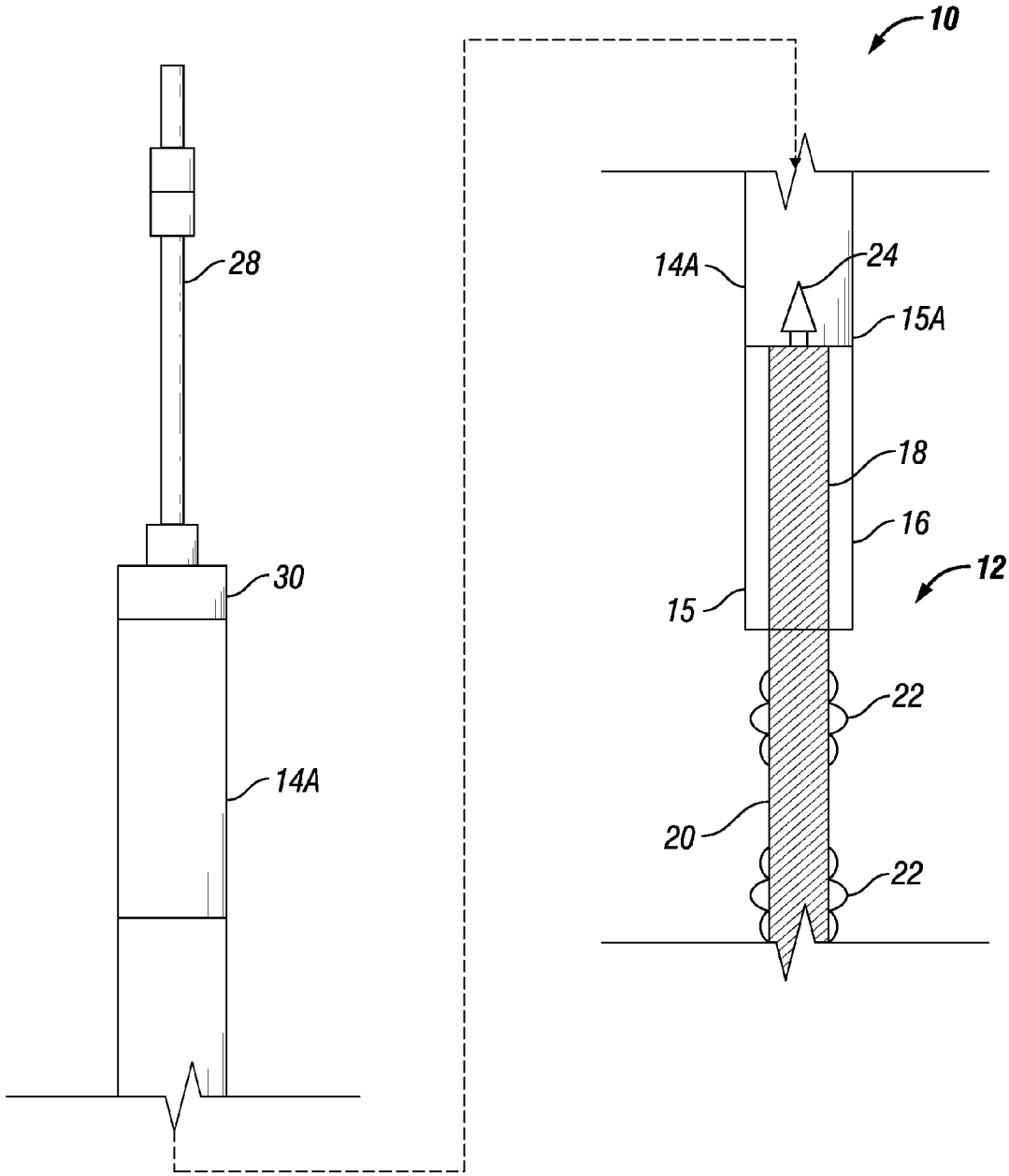
FIG. 3 is a partial cross-sectional view of another example of an assembly for stimulating reservoir formations while running casing as a liner.
Figure 4:
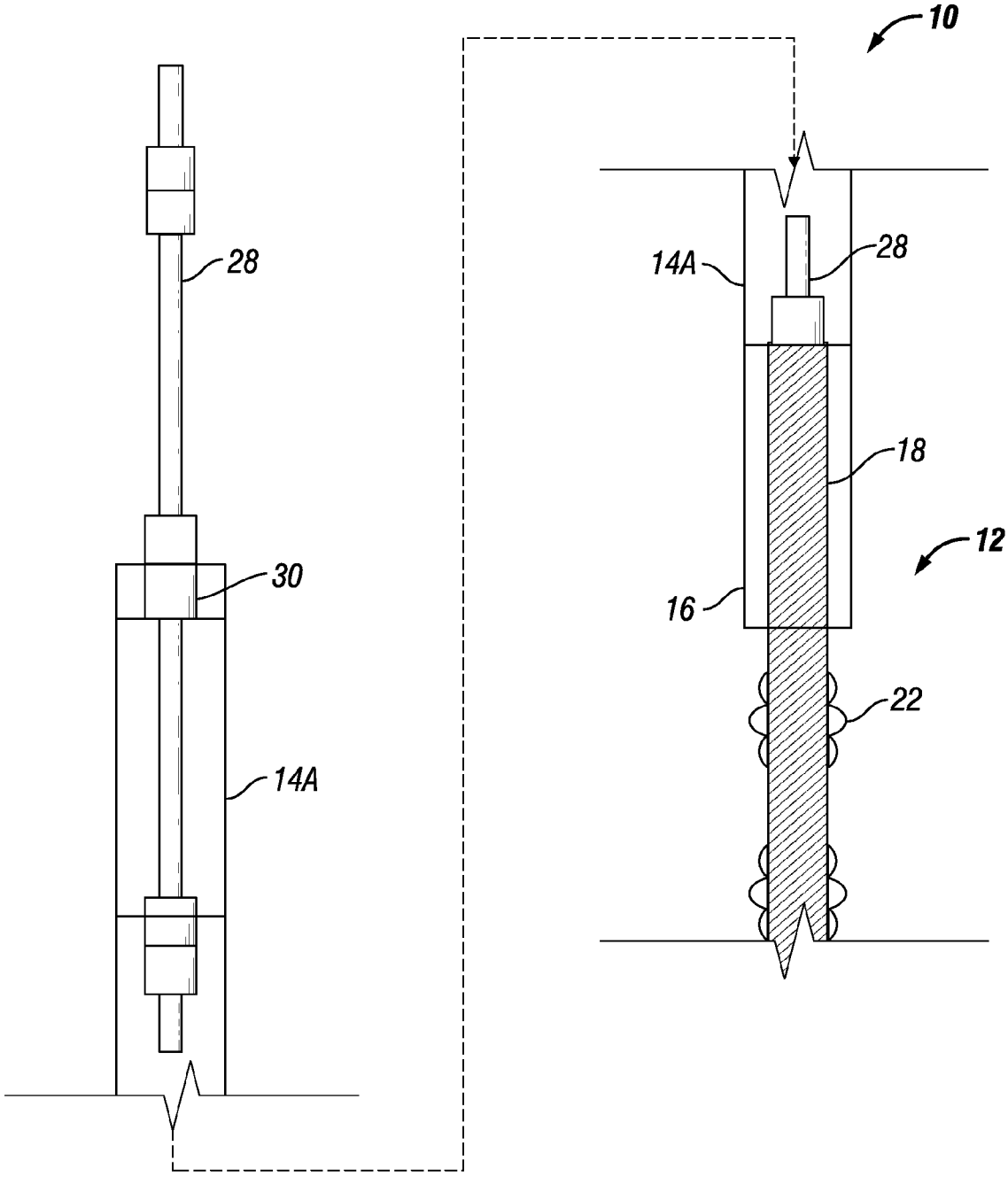
FIG. 4 is a partial cross-sectional view of another example of an assembly for stimulating reservoir formations while running casing as a liner.

Refer now to FIGS. 3 and 4 wherein examples of stimulation assembly 12 are illustrated in combination with liners 14*a*. Liners, unlike casing, do not extend from the surface but hang from another casing or liner. The liner is typically run into the well on the end of drill pipe 28 and attached by a liner hanger 30 to a larger diameter casing (or liner). The term casing commonly includes liners, and casing 14 is utilized herein to include liners.

In FIG. 3, stimulation assembly 12 is connected to liner 14*a* via latch mechanism 18 proximate to the bottom 15*a* of liner 14*a*. Liner 14*a* is connected to drill pipe 28 by a liner hanger 30. Upon completion of stimulation operations and the hanging of liner 14*a*, assembly 12 may be disconnected at latch 18 and removed utilizing retrieval member 24.

In the example illustrated in FIG. 4, assembly 12 is connected to drill pipe (drill string) 28 and may also be connected to liner 14*a* via latch mechanism 18. Again, after the stimulation operations are completed and liner 14*a* is hung, latch 18 may be disengaged from liner 14*a*, or casing, and retrieved from the wellbore. In should be recognized that assembly 12 may not be directly connected within liner 14 but positioned via drill string 28 which is connected to liner 14*a* at liner hanger 30.

Figure 5A:
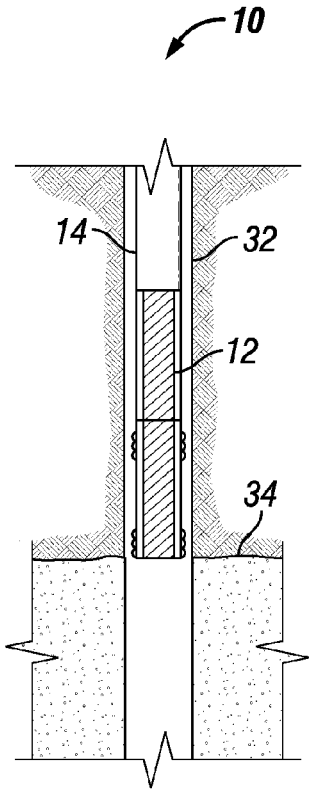
FIGS. 5A-5F illustrate an example of a method of performing reservoir stimulation while running casing.

Refer now to FIGS. 5A-5F wherein an example of a method of stimulating one or more zones of interest while running casing is illustrated. In FIG. 5A, stimulation assembly 12 is run into wellbore 32 on casing 14. It is again noted that, casing 14 includes liners 14*a*.

Figure 5B:
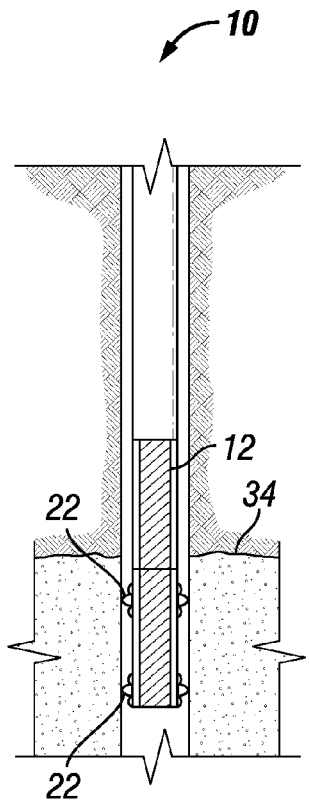

In FIG. 5B stimulation assembly 12 is shown positioned proximate to a formation zone 34. Packers 22 are then set, or actuated, to isolate zone 34 for stimulation. Although not illustrated, it is noted that formation zone 34 may be perforated before setting assembly 12. In an example of perforating formation 34, a wireline conveyed perforating gun may be lowered through system 10 and shot adjacent to formation 34.

Figure 5C:
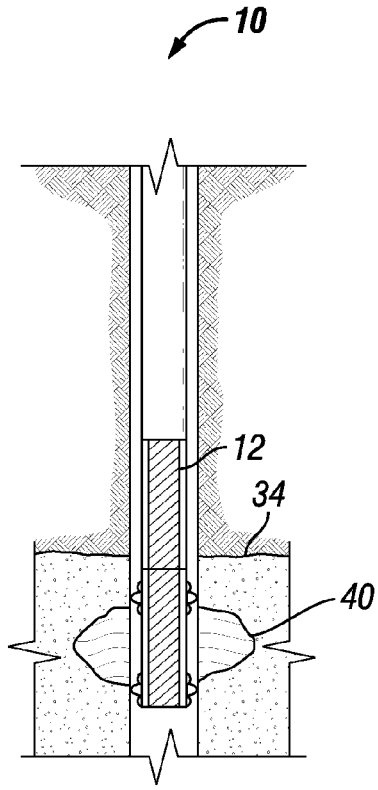

In FIG. 5C, zone 34 is stimulated by pumping a fluid 40 from system 10, between packers 22 into formation 34. Upon completion of the stimulation step, packers 22 are released. Fluid 40 may include any fluid known or contemplated for stimulation operations and may include components such as proppants, acids, tracer elements and the like. As previously described, fluid 40 may be pumped at pressures sufficient to fracture formation 34.

Figure 5D:
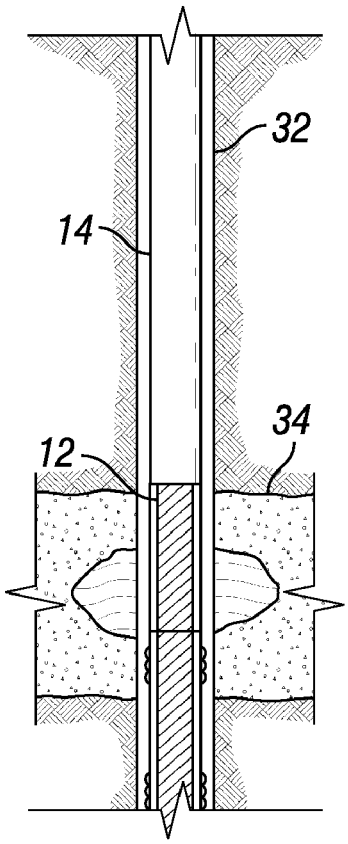
Figure 5E:
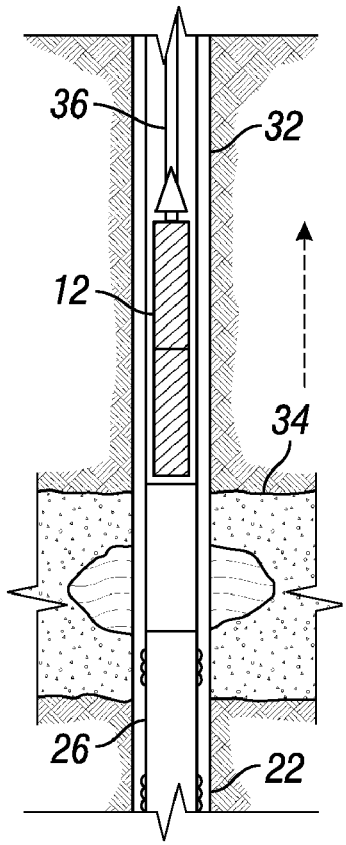

In FIG. 5D, assembly 12 is run further into wellbore 32 to the next zone of interest for stimulation or to the desired depth for setting casing 14, for example the total depth. In FIG. 5E, assembly 12 is disconnected from casing 12 by a conveyance 36, such as wireline or drill pipe, and retrieved from wellbore 32.

Figure 5F:
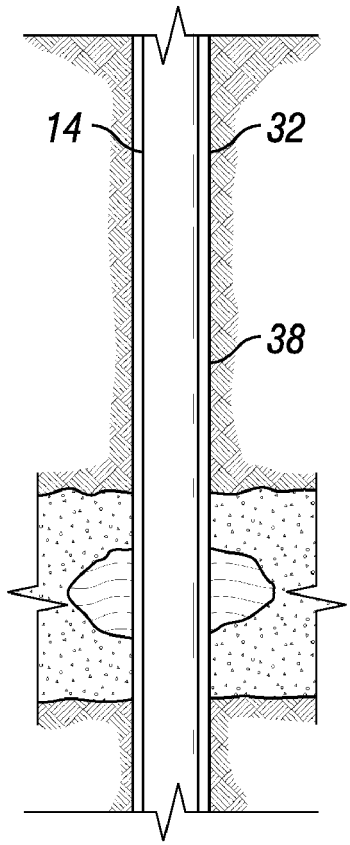

In the illustrated example, packers 22 are connected to the outside diameter of a portion 26 of the casing, as described in the example of FIG. 1. Thus, packers 22 remain in wellbore 32 while the remaining elements of assembly 12 are retrieved. In FIG. 5F, casing 14 is shown set with cement 38 in wellbore 32.

Figure 6:
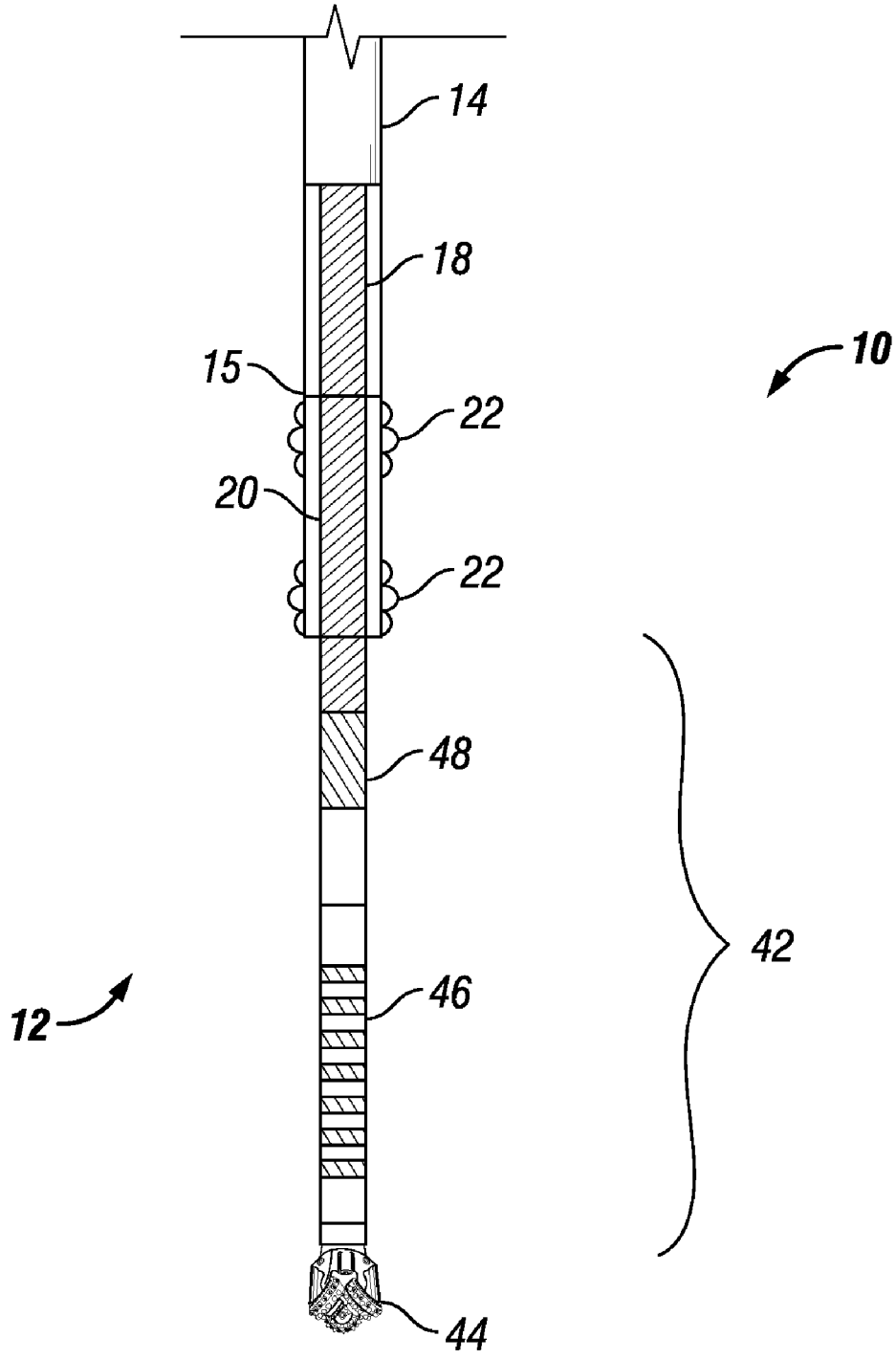
FIG. 6 illustrates an example of a stimulation assembly that includes logging and/or telemetry capabilities.

FIG. 6 is view of an example of stimulation assembly 12 including an additional assembly 42, referred to generally as a measurement assembly, to form a comprehensive bottom-hole assembly. Assembly 12 is connected to casing 14 by latch assembly 18. In this illustration, packers 22 are carried on the packer inflator 20. Measurement assembly 42 is connected to packer inflator 20 and extends from casing 14 and below (relative to the surface) bottom 15 of casing 14.

Measurement assembly 42 may include various tools, sensors, and instrument packages. For example, and without limitation, Measurement assembly 42 may include a working tool 44, such as without limitation, a drill bit, cutting devices, explosive devices, calipers, mud motor, sensors 46, and a telemetry package 48. Telemetry equipment such as an electromagnetic measurement while drilling ("MWD") tool or package 48 may be utilized, in particular for the ability to communicate without mud circulation. Mud pulse telemetry may be utilized as well.

Sensors 46 may include any number of sensors, gauges or instruments that may be utilized to obtain wellbore and/or formation data such as, without limitation, temperature, pressure, flow rates, resistivity, density, conductivity. Sensors 46 may include may include a logging while drilling ("LWD") package, for example. Examples of sensors 46, include without limitation, gamma ray detectors, nuclear magnetic resonance equipment, magnetometers, and bore imaging tools.

Another example of stimulating while running casing is described with reference to FIGS. 7A-7C. Bottom-hole stimulation assembly 12 including a MWD 48 package and LWD package 46 is connected with casing 14. In this example, packers 22 are carried on a portion 26 of casing 14. Measurement assembly 42, carrying LWD 46 and telemetry 48 extends substantially below casing 14 into the open hole section of wellbore 32.

Assembly 12 is run into wellbore 32 until positioned proximate to the first formation 34 to be investigated and stimulated. As is recognized, LWD 46 and MWD 48 facilitate running and positioning assembly 12 where desired. In FIG. 7A, formation 34 is logged prior to conducting stimulation operations.

Figures 7A, 7B, 7C:
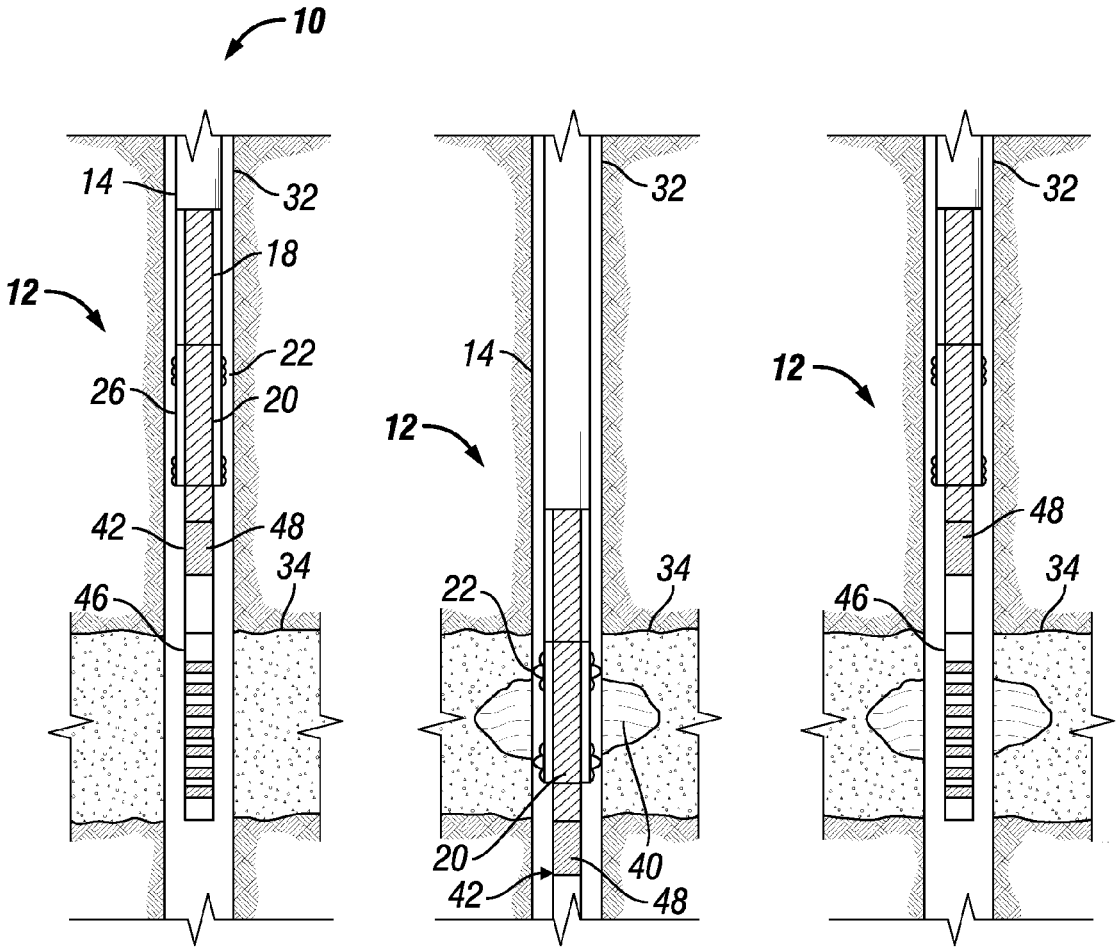
FIGS. 7A-7C illustrate a method of performing stimulation and logging operations while running casing.

In FIG. 7B, assembly 12 is run further into wellbore 32 until packers 22 are positioned relative to formation 34 as desired. Packers 22 are then actuated, for example by inflating to seal against formation 34. Fluid 40 is pumped down casing 14 and out of assembly 12 between packers 22 to stimulate formation 34.

Upon completion of stimulation operations, packers 12 are deactivated, freeing assembly for movement relative to formation 34. In FIG. 7C, assembly 12 is moved back up wellbore 32 repositioning LWD 46 relative to formation 34. Logging operations are again performed to obtain post stimulation data.

Some embodiments of the invention include isolating hydraulic fractures, to help achieve well integrity with various zones, both producing and non-producing, isolated from one another. Isolation may be achieved by placing materials in the annular volume between the casing and the formation that will prevent (or significantly reduce) flow of fluid from one zone to another in the annular region between the casing and the borehole. This approach varies from the conventional "drilling, complete and stimulate" process due to the way that the fracture stimulation treatments are placed into the reservoir before the well cementing (zonal isolation) treatment is performed.

Once all the zones have been stimulated, a wireline or coiled tubing conveyed device may used to retrieve the BHA. In one embodiment this may include the packers or screens. In another embodiment the packers or screens are left on the deepest section the casing and are cemented in place once the casing is run to total depth. Once the fracturing treatments have been completed the casing is run to the desired depth in the wellbore. As the annular isolation fluid is circulated into place, there may be a propensity for the isolation fluid to leakoff into the newly created individual hydraulic fractures that have been previously placed. It will be important that steps are taken to prevent or at least minimize fluid leakoff of the isolation fluids into the fracture so as not to damage the production capability of the fractures. This could be accomplished either internally to the fracture by adding materials to the hydraulic fracture process that will temporarily plug the fracture conductivity or externally by placing a film or sheath along the borehole walls that will completely seal off flow into the fracture systems. In one embodiment degradable materials are left in the tail of the fracture stimulation to prevent subsequent invasion of cement.

In another aspect, once the BHA has been retrieved, the casing is cemented in place. Cement is then circulated into the annular area between the casing and the borehole to provide support to the casing and also create a hydraulic seal to maintain zonal isolation of different fluids and gases found in the various layers of the strata. Zonal isolation and pipe support may still be necessary, although other materials known to those of skill in the art may be used for this application.

The stimulated fractures may need to be connected back to the wellbore once the casing is run completely to depth and is cemented in place. It will be beneficial for the zonal isolation material to be permeable allowing reservoir fluids to be produced through the isolation sheath and into the wellbore. Flow paths through the casing (perforations, slots, screens, etc.) will also need to be established.

The material used as the isolation material that is placed between the casing and wellbore could be made from conventional oilfield cement blends, but other alternate materials could provide improved fracture to casing connection while still providing the necessary isolation barrier between zones or layers. In order to provide a high permeable flow connection between the casing and the fracture to wellbore interface the isolation material should ideally not inhibit flow across the annular space. The isolation material could be a conventional oilfield cement that has been altered to provide some permeability. This could be accomplished by creating an acid soluble cement that contains a high concentration of additives which will be removed upon contact with acid. For this application the soluble cement would be removed only on very local basis at points adjoining wellbore perforations, slots or production holes in the casing and the wellbore to fracture interface. Alternatively, the cement may be designed to become porous and permeable. The base cement system could also be made from various resins or ceramics that could also be converted to a permeable system.

Another means of creating permeable cement is to intentionally fracture the cement once it is set. The completion can be designed to simply fracture the cement only adjacent to the fractured intervals. The fractures will provide sufficient permeability through the cement while the unfractured cement above and below the perforations will provide the required hydraulic seal to prevent unwanted fluid migration between intervals.

The isolation process may be performed more like a gravel pack than a cement treatment and gravel could be place in the annular void. Ideally the gravel will utilize some type of additional material that is capable of stabilizing the grains of gravel and will prevent it from flowing back into the wellbore through the perforations or slots. There a numerous ways the grains can be stabilized including sticking the grains together using resin, plastics or glue; using fibers, plates or rods to bridge and hold the gravel in place; using sticky, tackifying agents; using soft particles that expand; and the like. Another possible way of providing a good hydraulic seal would be to place an expanding or swelling material on the outside of the casing. This expanding material could be a conventional expanding packer that is extended either hydraulically or mechanically or a material that swells upon the contact of a given fluid such as brine or hydrocarbon, such as those described in U.S. Pat. No. 7,143,832, incorporated herein by reference in its entirety. One preferred method would be to have an elastomer material placed on the outside of the casing that would swell and expand to fill the annular void only when triggered. The trigger mechanism would take place when a specific fluid is circulated into the annulus and across the elastomer allowing the elastomer to react with the trigger fluid and swell until a seal is formed between the casing and the borehole wall. This effectively creates an "o"-ring seal on the outside the casing.

In another embodiment, the casing would be of the expandable casing type, and after reaching the designed depth, the casing would be expanded. Expandable casing that expands into a porous (or perforated) shell may be applied and would eliminate the need to perform casing perforation to connect the fracture to the wellbore. In yet another embodiment a permeable gravel pack is placed behind the casing.

Hydraulic fractures created while running casing into the well will need to be connected to the wellbore after the well casing is cemented into place. Two important issues exist: 1) connecting the hydraulic fracture to the "perforations", and 2) finding the hydraulic fracture. Whereas the depth should be known from the number of casing joints at the moment of the hydraulic fracture treatment, the orientation of the fracture will be unknown. Improper orientation of perforations will miss the hydraulic fracture, thus there will be a flow constriction, or choke, at the wellbore. Furthermore, an optional contingency may exist to locate the position or depth of the fracture in case some problem caused the fracture depth to be unknown or uncertain.

A variety of different perforation techniques may be used to orient the perforations and ensure that the fracture is connected to the wellbore without a near wellbore choke. A number of different tracers can be used to find or detect the fracture behind the casing. In another embodiment a wireline logging tool with perforating guns is lowered into the well. A gamma-ray logging tool may be used to locate the reservoir intervals and phased perforation is used to connect to the hydraulic fractures. One method of connecting a frac with the perforations is to create a 360 degree perforation around the circumference of the casing. This "360 degree" perforation may be a band or a spiral. This perforation may be cut using an abrasive jetting tool to cut the casing and the cement behind the casing.

Alternatively, an acid soluble cement and an abrasive jetting tool could be used to erode a hole in the casing and then a acidic solvent could be injected through the jetting nozzle to dissolve the cement. Rotating jetting tools will improve the means of cutting a 360 degree hole. Assuming one knew the location of the productive intervals that would be fracture stimulated before running the casing (i.e., open hole formation characterization logs were run before casing) then one may design the casing string to have special casing segments that are easily perforated. For example, the casing joints that will reside across the fractured zone will have fatigued "burst-disk" portions that will be opened at a predetermined pressure pulse. Another example would be the casing is already perforated and the perforations filled with temporary structural plugs, such as acid soluble aluminum plugs, or structural plastics that will hydrolyze and dissolve when exposed to a specific chemical environment.

Further, plugs may be wedges of a material or dimples that can be knocked off of the casing or sheared off the casing by a tool (see packers plus cutter sub). In each of these cases, the cement behind casing still needs to be perforated. A chemical treatment that would dissolve the cement is acceptable. The use of a permeable cement is another way to produce through the casing. In all embodiments of the invention, the cement may actually be a sand/gravel pack, consolidated gravel, conventional cement, a fractured cement, or some other permeable structural material. One may connect to the fracture using a different zonal isolation method altogether. Instead of cementing the annulus across the productive intervals, the casing could be run with swellable elastomers between each target zone. Once the casing is in place, a fluid will activate the swelling elastomer, which will create a seal in the wellbore between the various fractures. The annular space between the elastomers will be completely open, and any perforation through the casing in the open space, will permit hydrocarbon production without restriction from the hydraulic fracture. Thus, any hole in the casing, will communicate hydraulically through the permeable cement to the fracture. In another embodiment, one could employ a casing segment with a sliding sleeve. In yet another embodiment, one may deploy casing with propellant or perforating charges strapped to the outside of the casing, which are fired after the cement is set.

There are numerous alternative well construction techniques that create different opportunities for connecting the fracture to the wellbore. Expandable casing can be used and virtually eliminates the need to cement the casing in place. This will reduce the potential for fracture damage during wellbore cementing. Expandable screens eliminate the need to perforate or abrasive jetting altogether, i.e., steel casing that forms a multitude of tiny slots or holes that dilate upon expansion.

Materials can be added to the fracture that may be detected from inside the casing. The materials can be added to the proppant, and most likely would be added to the last portion of the proppant added to the fracture. In some cases, in order to mark the fracture, a tracer can be added to the fracture shield/filtercake or added to the fracture itself. The tracers can be used to orient conventional perforation shots in the direction of the fracture. Tracers may be used to locate the position of the fracture along the axis of the wellbore. Tracers can include magnetic particles, radioactive particles, conductive particles, and chemical species. Although, it must be stated that chemical tracers will only be detected by sampling fluid spiked with those chemicals. Thus, chemical tracers will be of utility after the fractures are connected to the wellbore and put on production. Then these tracers may be used to facilitate evaluation of the contribution of each fracture to the total production of the well and to facilitate determination of the effectiveness of the fracture clean up process.

U.S. Pat. No. 7,032,662 describes some nonlimiting examples of chemical tracer materials. The tracer may be a radioactive tracer and monitored by a spectral gamma ray detector. U.S. Pat. Nos. 5,635,712, 5,929,437, describe some examples of radioactive tracers. The tracer may be a non-radioactive particle having a ceramic matrix and an element that can be bombarded with neutrons to produce a gamma ray emitting isotope (ref U.S. Pat. No. 5,182,051). The tracer may be a metallic element and detected by a magnetometers, resistivity tools, electromagnetic devices, long and ultra long arrays of electrodes (reference U.S. Pat. Nos. 7,082,993, 6,725,930). Magnetized materials such as those from the group consisting of iron, ferrite, low carbon steel, iron-silicon alloys, nickel-iron alloys and iron-cobalt alloys can also be used as tracers (ref U.S. Pat. No. 6,116,342). U.S. Pat. No. 6,691,780 also describes non-radioactive metals, metal oxides, metal sulfates, metal carbonates, metal phosphates and more that may change the response of magnetometers, differential magnetometers (gradiometers), resistivity tools, electromagnetic devices, and long/ultra long arrays of electrodes.). Another way of creating a fracture that responds to stimulus, is to add to the proppant some particles that are coated in electro conductive resin and then sending an electric current in the formation in the vicinity of the fracture and then receiving the electrical signal and interpreting the signal to determine whether it indicates the presence or absence of the fracture (reference U.S. Pat. No. 7,073,581). In all the aforementioned methods of adding tracers to the fracture, it is implied that the tracer can be added to the proppant and enter the fracture or that the tracer may be added to the fluid that is protecting the fracture and forms a filtercake at the intersection of the fracture and the wellbore.

In accordance with embodiments of the invention, apparatus and method for acoustically logging a borehole to detect anomalies in the earth formation beyond the borehole may be used. Also, as described in US Statutory Invention Registration US H2116H, methods of locating fluid filled fractures behind casing may be used. Generally, methods may be used to locate the hydraulic fractures, as long as the fracture is largely oriented along the wellbore axis. for advances that have taken place since that patent.

In another embodiment the depth is determined by casing tally rather than a logging tool.

In one embodiment of this invention the final proppant stage is tagged with a tracer material that will enable the fracture to be detected by logging tools. This may be used to determine fracture height and or orientation.

In another embodiment a wireline logging tool with oriented perforating guns is lowered into the well. The wireline tool detects the fracture by sensing a tracer injected in the flush stage of the stimulation. This information is then used to orientate the perforating guns to connect the fractures to the wellbore. Possibly openhole logs will already have been performed so it will be possible to run in with designer casing strings with prefitted slots/perfs/fatigued areas, and the like.

In an embodiment of the invention logs collected prior to running casing (either using logging while drilling or wireline logging tools) are used to determine which sections of casing will be adjacent to the reservoir intervals once the casing is lowered to total depth. The casing string is made up such that special sections of casing with helically arranged indents are located at these points. Once the casing is cemented, using an acid-soluble cement, a cutter sub is pumped from surface and used to shear the indents, thereby opening the casing to the zones that have been fractured. Acid is then pumped to remove the cement and allow the hydraulic fractures to communicate with the wellbore.

In another embodiment of the invention a jetting tool is used to cut helical slots through the casing and cement adjacent to the stimulated zones and allow the hydraulic fractures to communicate with the wellbore.

The fractures need to be protected against damage from the cementing process, one may add the tracer material to the fracture "shield." The fracture shield may be a filter cake or a film forming material. For example, fibers from PLA (polylactic acid) or PET (polyethylene terephthalate) are known to be used in forming a good filter cake. Latex particles can create good filtercakes on low permeability media. Mixing smaller size particles with the proppant in the fracture, such as graded calcium carbonate particles that fit into the pores within the proppant pack will reduce permeability and be soluble in acid, which can be injected to remove that temporary plugging agent. One may also use swollen hydrogels, or use temporary structural plastics, such as small PLA or PET particles to temporarily reduce fracture hydraulic conductivity and protect it during the cement process.

Embodiments of an apparatus of the present invention provide a bottom hole assembly that enables stimulation whilst running casing (or a liner). The BHA is retrievable after all of the stimulation treatments have been completed.

Embodiments of an apparatus of the present invention enable simultaneous measurement of pressure and transmission to surface, simultaneous measurement of formation evaluation and image logs and transmission to surface, simultaneous measurement of microseisms events and transmission to surface, and simultaneous measurements of chemical compounds and transmission to surface.

Embodiments of an apparatus of the present invention provides a system to shear indents from casing and connect to hydraulic fractures by pumping acid to remove cement adjacent to packers. Alternatively, the system is operable to cut helical slots in casing or liner in order to connect to hydraulic fractures by pumping acid to remove cement adjacent to packers, to cut perforate the casing or liner in order to connect to previously created hydraulic fractures.

Embodiments of an apparatus of the present invention also provide an interpretation system to determine fracture properties using measurements collected by above systems (real-time and post-job).

Embodiments of an apparatus of the present invention includes a fracture assembly comprising a device that can create holes in the casing, such as, but not limited to, a perforation gun carriage, an abrasive jetting tool, a rotating jetting tool, a propellant stick/charge, a cutter sub, or a canister containing reactive chemicals.

Embodiments of an apparatus of the present invention comprise a casing string that is either a plain casing string or has deliberately placed casing segments that comprise feature(s) that promotes the formation of a "perforation" through the casing itself, such as, but not limited to, holes filled with temporary plugs (soluble in acids, designed to hydrolyze or corrode or decay away), weakened areas that will burst, like a burst disk, when exposed to a specific pressure pulse, dimples designed to be sheared away by a tool or cutter sub run through that portion of casing, sliding sleeves and ball/dart catcher.

Embodiments of an apparatus of the present invention comprise tools that can detect the materials used to mark the fracture or filtercake used to protect the fracture, such as, but not limited to, gamma ray detectors, magnometers, and conductivity meters.

Embodiments of an apparatus of the present invention may comprise special casing element(s) comprising external swellable packer elements used to isolate the zones between fractures during production.

Embodiments of an apparatus of the present invention may comprise expandable casing element(s) used to isolate the zones between fractures during production. These elements will have a multitude of holes that will dilate upon expansion and provide hydraulic connectivity between fractures and the formation.

Embodiments of an apparatus of the present invention may comprise a LWF tool which is set below the fracturing system, powered by battery, a LWF tool which sends the data to the surface using high data rate electro-magnetic transmission (using E-pulse for example), or a LWF tool which can receive command from surface using electro-magnetic transmission (using E pulse for example)

Embodiments of an apparatus of the present invention may comprise a tool which comprises at least one pressure transducer, a hydrophone, at least one geophone, a device to measure the hole diameter, preferably a high precision caliper like a sonic caliper, but could be a density neutron caliper or even a four arm caliper, an electrical borehole imaging device like the GVR4 or GVR6, a set of electrodes to measure the electromagnetic field, a set of coils to measure the electro-magnetic field, a tool which comprises a set of sonic transducers, include monopole and quadropoles, chemical sensors, and may be operable to send pressure pulses on demand.

Embodiments of a method of the present invention may comprise pumping stimulation treatment through the casing during the process of running casing (or liner) into a wellbore. The process of running the casing may be paused with the end of the casing or the bottomhole assembly tools across from the first interval to be stimulated. The method may further comprise running the casing into the wellbore after the treatment is pumped. The steps may be repeated allowing as many zones to be stimulated as desired.

Embodiments of a method of the present invention may further comprise running the casing to the wellbore bottom once the last zone is stimulated. The method may further comprise isolating various zones or intervals in the casing and wellbore annulus after the casing is at the wellbore bottom. The method may further comprise perforating the casing.

Embodiments of a method of the present invention may comprise circulating a clear completion fluid is circulated into the annulus and across the interval that is to be stimulated prior to pumping the stimulation fluid and repeating the circulating step before each interval that is to be isolated and stimulated. A portion of the bottomhole assembly may comprise logging and measurement tools.

Embodiments of a method of the present invention may comprise performing logging measurements, and/or performing microseismic monitoring while hydraulic fracturing while running casings or liners into a wellbore. The method may further comprising reconnecting to previously created fractures by slotting/perforating/shearing indents. The method may further comprise placing prop/acid/heterogeneous proppant/solid acid in the fractures. The method may further comprise providing real-time pressure while fracturing.

Embodiments of a method of the present invention may comprise running a bottomhole assembly system on the casing that is capable of hydro-jetting or abrasively jetting the formation prior to stimulation so as to facilitate fracture initiation and utilizing the jetting assembly is used to stimulate the reservoir Embodiments of a method of the present invention may comprise creating a fracture while running the casing into the well, and then creating a conductive pathway through the casing. The method may further comprise using a cement to stabilize the casing and isolate the zones. The cement may be a fractured cement, a permeable cement, or a consolidated a consolidated or unconsolidated porous media (gravel, resin coated gravel, gravel treated with a resin system to consolidate it. The method may further comprise using a swellable elastomer to stabilize the casing is stabilized and isolate the zones. The conductive pathway may be created by a conventional perforation charge, by an abrasive jetting tool creating a pathway having a geometric shape of a hole, a slot, a spiral, or a band circumscribed along the radius of the casing. The conductive pathway may be created by dissolving plugs in the casing that fill pre-existing holes. The plugs may be aluminum, structural plastics, or other materials that dissolve more rapidly and completely than the casing in the treatment fluid. The conductive pathway may be created by running a tool through the special casing segment. The tool, which may be described as a cutter sub, is designed to shear dimples or wedges that cover pre-existing holes in the casing. The conductive pathway may be created by pressurizing the casing above the burst pressure of pre-existing weakened areas in the casing surface, i.e., burst disk elements.

Embodiments of a method of the present invention may comprise adding a marker or tracer to the tail of the fracture treatment or to the fracture shield and then detecting that marker with a logging tool inside the casing. Using that location to specify the location of the process of creating a conductive pathway through the casing. The tracer may be a radioactive tracer and monitored by a spectral gamma ray detector. Reference U.S. Pat. No. 5,635,712 or 5,929,437, for some examples of radioactive tracers. The tracer may be a metallic element and detected by magnetometers, resistivity tools, electromagnetic devices, and long and ultra long arrays of electrodes (reference U.S. Pat. No. 7,082,993).

Embodiments of a method of the present invention may comprise making MWD/LWD measurements during the drilling process to acquire all the necessary information to plan the fracturing job and to get a reference wellbore image to ensure good detection of the fracture location during the subsequent measurements made during and after the fracturing job. Knowledge of wellbore inclination and azimuth is required for induced seismically measurement interpretation. Some measurements could be made on Wireline. The method may further comprise LWF measurement attached to a Fracturing Assembly (FA) to make all the relevant measurements just before, during, and after the fracturing jobs. Some measurements are made during tool movements and some are made while the tool is locked in place and the fracturing is carried out.

Embodiments of a method of the present invention may comprise making a series of measurement prior to fracturing for fracture characterization which include measurements for reservoir characterization (in particular sonic measurement, ultrasonic measurement, wellbore images), and wellbore images for reference. Similar measurements can be made after the fracturing job, while the FA is pulled out the hole. The measurements may comprise: GVR to detect the fractures at the wellbore wall, allowing one to determine the orientation and in case the fracture is aligned with the wellbore axis, the height; Caliper, which if is of high resolution, allowing one to determine the fracture width along the wellbore, and in some cases the fracture slippage if any; and propagation resistivity (ARC or Periscope or MCR) which can see axial fractures and will be able to detect up to about at least 5 meters of length in OBM.

Embodiments of a method of the present invention may comprise making a series of measurements during the fracturing job, including the fracture closing period, and even some time after the closure including, but not limited to: pressure measurement; electro-magnetic field to detect when the fracture is initiated, and propagated thanks to electrokinetic effects; induced seismically using 3D geophones to detect event locations, which can be combined with measurements from adjacent wellbores (VSI); and chemical measurements.

Embodiments of a method of the present invention may comprise protecting the hydraulically stimulated fractures from subsequent losses of cement, synthetic cement, drilling fluids, completion fluids or other fluids that may be circulated past the fracture—wellbore connection. by temporarily reducing the fracture permeability by adding damaging or plugging materials to the fracture that are removable. The damaging materials for fractures filled with proppant may comprise materials a) sized to fill the porosity of the pore throat voids in between the individual grains of proppant, which may require several small sizes of particles used, each successive smaller size designed to fill the next smaller pore throat size; b) materials that are deformable so that upon fracture closure the deformable material will squeeze throughout the pore throat voids in between the individual grains of proppant; and c) a fluid that sets to a gel. The damaging materials for etched fractures created by acid fracturing the damaging materials may comprise a combination of one or more materials of various sizes, shapes and structures including gels, spheres, grains, platelets, flakes, or fibers blended together that will form a low permeability mass when the fracture closes.

Embodiments of a method of the present invention may comprise placing a material in the annulus to support the pipe and provide zonal isolation between the various layers of the strata. The zonal isolation will prevent fluid or gas of one zone layer from contacting or mingling with the fluid or gas of another layer in the annular area between the casing and the borehole wall. The zonal isolation material may comprise a cement or blend of cement and extenders such as, but not limited to, pozzolan, sodium silicate, bentonite, barite, nitrogen (use to create a foam), aggregates (such as sand, gravel, carbonate particles), cement that has been specifically designs to be soluble or dissolvable, cement that has been designed to have permeability or become more permeable over time, cement that has been designed to become permeable through the addition of one or more of materials that create interconnecting voids including but not limited to the following: hydrogels, foam bubbles, particles or fibers of polyglycolic acid and/or polylactic acid, cement that has been designed to become permeable by creating fractures through the creation of controlled stress fractures, synthetic cements such as resins or plastics, synthetic cements such as resins or plastics that have been designed to become permeable over time, and/or synthetic cements such as resins or plastics that have been designed to become permeable over time through the addition of one or more of materials that create interconnecting voids including but not limited to the following: hydrogels, foam bubbles, particles or fibers of polyglycolic acid and/or polylactic acid.

Embodiments of a method of the present invention may comprise using casing segments that have swellable elastomer bands in predetermined places. The swellable elastomers will swell to fill the annular space between the casing and the formation when it is contacted by an appropriate solvent. The swellable elastomer elements create zonal isolation between fractures.

Embodiments of a method of the present invention may comprise using expandable casing. The expandable casing stabilizes the wellbore and keeps the casing in place. An elastomeric coating may exist on the outer surface of the expandable casing to improve the hydraulic seal between the casing and wellbore face. Pre-perforated casing segments may be installed in predetermined positions, which open and provide hydraulic conductivity upon expansion.

Embodiments of a method of the present invention may comprise pumping a stimulation treating through the casing during the process of running casing (or liner) into a wellbore a stimulation treatment is pumped through the casing. The process of running the casing is paused with the end of the casing or the bottomhole assembly tools across from the first interval to be stimulated. The treatment is pumped and then the process of running the casing into the wellbore is started again. The steps are repeated allowing as many zones to be stimulated as desired. Once the last zone is stimulated the casing is run to the wellbore bottom as would be done in a conventional casing operation. The various zones or intervals in the casing and wellbore annulus are isolated after the stimulation process has been completed and casing is on bottom.

From the foregoing detailed description of specific embodiments of the invention, it should be apparent that a system for stimulating on or more reservoir formations while running casing that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A method for conducting wellbore operations in a well while running casing into the wellbore, the method comprising the steps of:

connecting a stimulation assembly to a casing string;

running the casing string into the wellbore;

positioning the stimulation assembly at a selected reservoir formation;

performing a stimulation operation at the reservoir formation;

running the casing string and stimulation assembly to the next desired position in the wellbore;

disconnecting the stimulation assembly from the casing string after the reservoir stimulation operations have ceased;

retrieving the stimulation assembly from the wellbore; and cementing the casing in the wellbore.

2. The method of claim 1, wherein the reservoir stimulation operation includes pumping a fluid through the stimulation assembly and into reservoir formation.

3. The method of claim 1, wherein the stimulation assembly includes:

a latch assembly in releasable connection with the casing string;

a pair of spaced apart packers; and a packer actuator operationally connected to the packers and the latch assembly.

4. The method of claim 3, wherein the packers are positioned on the packer actuator.

5. The method of claim of claim 3, where in the packers are positioned on the casing string proximate to the bottom of the casing string.

6. The method of claim 1, wherein the step of performing a reservoir stimulation operation further includes the steps of:

activating the stimulation assembly to form a substantially isolated reservoir zone to be stimulated;

pumping a fluid through the casing string and out of the stimulation assembly into the isolated reservoir zone.

7. The method of claim 1, wherein the casing string is a liner.

8. The method of claim 1, further including:

providing a sensor connected to the stimulation assembly; and logging the desired formation with the sensor.

9. The method of claim 1, further including:

providing a sensor connect to the stimulation assembly;

logging the reservoir formation with the sensor before the step of performing the reservoir stimulation operation; and logging the desired formation with the sensor after the step of performing the reservoir stimulation operation.

10. A method for stimulating a reservoir formation while running a casing string into the wellbore, the method comprising the steps of:

connecting a stimulation assembly to the casing string, the stimulation assembly including a packer actuator in operational connection with a packer and a logging sensor;

running the casing string into the wellbore and performing a first positioning operation of the logging sensor proximate to a selected reservoir formation;

performing a first logging operation of the reservoir formation;

positioning the stimulation assembly proximate to the reservoir formation;

actuating the packer to substantially isolate the reservoir formation from the wellbore;

performing the stimulation operation;

releasing the packers from sealing engagement with the wellbore;

performing a second positioning operation of the logging sensor proximate to the reservoir formation;

performing a second logging operation of the reservoir formation;

disconnecting the stimulation assembly from the casing string; and cementing the casing string in the wellbore.

11. The method of claim 10, wherein the casing string comprises a liner and the liner is conveyed into the wellbore on a drill string.

12. The method of claim 10, wherein the logging sensor is a logging sensor assembly.

* * * * *